United States Patent [19]

Rogers

[11] 3,942,339

[45] Mar. 9, 1976

[54] CARRIAGE FOR HAND KNITTING MACHINES HAVING INTEGRAL JACQUARD CAM PATTERN CHANGING MEANS

[75] Inventor: Howard D. Rogers, Westfield, N.J.

[73] Assignee: The Singer Company, New York, N.Y.

[22] Filed: Feb. 14, 1974

[21] Appl. No.: 438,830

[52] U.S. Cl. ..... 66/75 R; 66/60; 66/78

[51] Int. Cl.[2] ..... D04B 7/00

[58] Field of Search ..... 66/64, 60 H, 78, 75, 57, 66/169

[56] References Cited

UNITED STATES PATENTS

| | | | |
|---|---|---|---|
| 2,830,446 | 4/1958 | Opawa | 66/78 R |
| 3,299,673 | 1/1967 | Noll | 66/57 |
| 3,304,748 | 2/1967 | Seiler | 66/64 |
| 3,405,542 | 10/1968 | Beckenstein | 66/57 |
| 3,748,873 | 7/1973 | Nakane et al. | 66/78 R |

FOREIGN PATENTS OR APPLICATIONS

| | | | |
|---|---|---|---|
| 1,205,649 | 1/1965 | Germany | 66/78 R |
| 496,097 | 6/1954 | Italy | 66/78 R |
| 368,890 | 6/1963 | Switzerland | 66/60 H |
| 83,500 | 5/1935 | Sweden | 66/78 R |

*Primary Examiner*—Mervin Stein
*Assistant Examiner*—Andrew M. Falik
*Attorney, Agent, or Firm*—Marshall J. Breen; Edward P. Schmidt; Robert E. Smith

[57] ABSTRACT

A carriage for a hand knitting machine in which a plurality of cams, including upper and lower Jacquard cams, are sequentially arranged and are adjustable between inoperative and operative positions so as to define at least one raceway for the butts of needles reciprocable in the needle bed of the machine. At least the upper and lower Jacquard cams are actuable by individually operable lever means between said inoperative and operative positions. At least one of the lever means is interconnected with at least one of the other lever means such that actuation of one of the said lever means simultaneously actuates at least one of the other lever means to thereby actuate a predetermined combination of said cams.

5 Claims, 12 Drawing Figures

CARRIAGE FOR HAND KNITTING MACHINES HAVING INTEGRAL JACQUARD CAM PATTERN CHANGING MEANS

BACKGROUND OF THE INVENTION

This invention relates to the field of hand knitting machines and more particularly to an improved carriage and cam control system for a knitting machine of this character capable of producing both Punch Lace and Fair Isle knitted patterns.

It is conventional to utilize with the needle bed of a hand knitting machine a carriage which mounts a plurality of cams on its underface so that when it is reciprocated along the slide rails of the bed the cam system operates upon the butts of the needles to effectuate the desired knitting pattern. As is well known, the carriage may be manually operable or it may be adapted for reciprocation under the influence of a motor drive.

Carriages presently in use are capable of producing various patterns of knitting. In order to provide such a capability the several cams are adjustable either through direct individual manipulation or indirectly through the actuation of a punch key and connecting lever. In the latter instances the customary construction links individual punch keys and levers with individual cams. Alternately, a selector dial may be rotated to a predetermined position in order to establish a specific cam raceway for production of a particular knitted pattern. Known carriages of this type generally employ escapement cams which are permanently biased and are, therefore, susceptible to spring failure. Also, such carriages are generally heavy and occupy a relatively large area of the needle bed, thereby increasing the possibility of needle jam-up beneath the carriage.

Further, it has been found desirable to provide a carriage with a capability for producing Punch Lace and Fair Isle knitting patterns. The Singer Model 2200 knitting machine permits the production of the latter pattern but does not enable the operator to produce Punch Lace (a simulated lace pattern), wherein a design of a chosen colored yarn is produced by means of knit stitches on needles selected to form the design. A fine yarn or thread is knit on every needle, thus forming a stocking stitch structure. If some (non-selected) needles form knit stitches with both colored yarn and fine thread, and the remainder of the needles form knit stitches using only the fine thread, a fabric is produced where the fine thread is nearly invisible and the design appearance is formed in colored yarn.

SUMMARY OF THE INVENTION

In view of the foregoing it is one object of this invention to provide a carriage for a hand knitting machine having the capability of producing Punch Lace and Fair Isle knitting patterns.

It is another object of this invention to provide a carriage for a hand knitting machine which is lightweight, occupies a relatively small area of the needle bed of the machine, and affords the operator the choice of a multiplicity of patterns through a simple punch key and interconnecting lever system.

Yet another object is the provision of a carriage for a hand knitting machine having a plurality of punch keys, each of such punch keys being operable to actuate at least one cam of the carriage with which such key is directly connected and at least one of such punch keys being operable to actuate additional cams with which such punch keys are indirectly connected.

According to the present invention there is provided in a carriage for a hand knitting machine having a plurality of cams that are sequentially arranged and adjustable between inoperative and operative positions to thereby define at least one raceway for the butts of needles and in which a plurality of said cams are operatively connectable to individually actuable lever means to be shifted between said inoperative and operative positions, the improvement which comprises means for interconnecting at least one of said lever means with at least one other of said lever means whereby actuation of one of said lever means simultaneously actuates at least one other of said lever means to thereby actuate predetermined combinations of said cams.

According to the present invention there is also provided in a carriage for a hand knitting machine having needle selecting, raise and stitch cams arranged sequentially at both ends thereof, at least one set of Jacquard cams positionable to produce patterned knitting, a cam positioning lever associated with each set of said Jacquard cams and a locking plate for locking said lever in predetermined position to thereby maintain the Jacquard cams associated therewith in the selected pattern, the improvement which comprises upper and lower sets of said Jacquard cams, first lever means operably associated with said upper Jacquard cams and actuable to engage said locking plate and effectuate a shifting of said upper Jacquard cams upwardly from a first position into a second operative position such that a first path is established whereby selected needles are directed over a first of said upper Jacquard cams and beneath the other of said upper Jacquard cams to a point along said path where a first yarn can be accepted and thence to the upper portion of one of said stitch cams and downwardly therealong and out of said carriage, said lower Jacquard cams remaining in a first position such that a second path is established whereby non-selected needles are directed across the top of said lower Jacquard cams to a point where said non-selected needles can accept said first yarn and a second yarn before being directed to substantially the same upper portion of said one stitch cam and downwardly thereof along the same path followed by said selected needles, second lever means operably associated with said lower Jacquard cams and actuable to engage said locking plate and effectuate a shifting of said lower Jacquard cams upwardly from said first position into a second operative position such that non-selected needles are directed over a first of said lower Jacquard cams and beneath the other of said lower Jacquard cams to a yarn-accepting level and thence to join selected needles at a lower region of said one stitch cam, engagement of said second lever means with said locking plate effecting, when said first lever means has already been actuated, sequentially an unlocking of said first lever means from said locking plate and then a relocking of said first lever means by said locking plate, whereby actuation of only said first lever means enables the production of Punch Lace and actuation of said second lever means enables the production of Fair Isle knitting.

BRIEF DESCRIPTION OF THE DRAWINGS

In order that the invention may be more fully understood it will now be described, by way of example, with reference to the accompanying drawings in which.

DETAILED DESCRIPTION OF THE INVENTION

Figure 2:
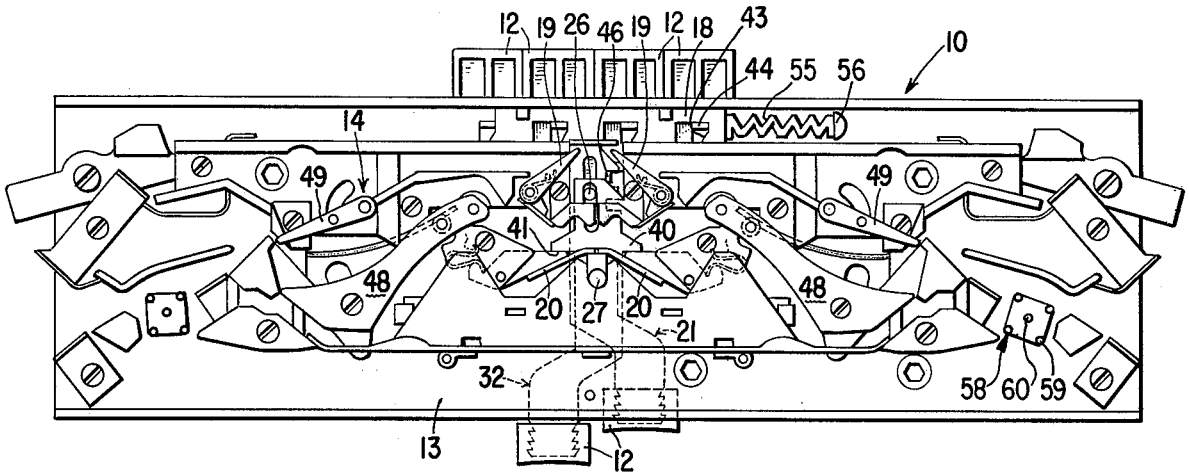
FIG. 2 is a bottom plan view of the carriage of FIG. 1.
Figure 1:
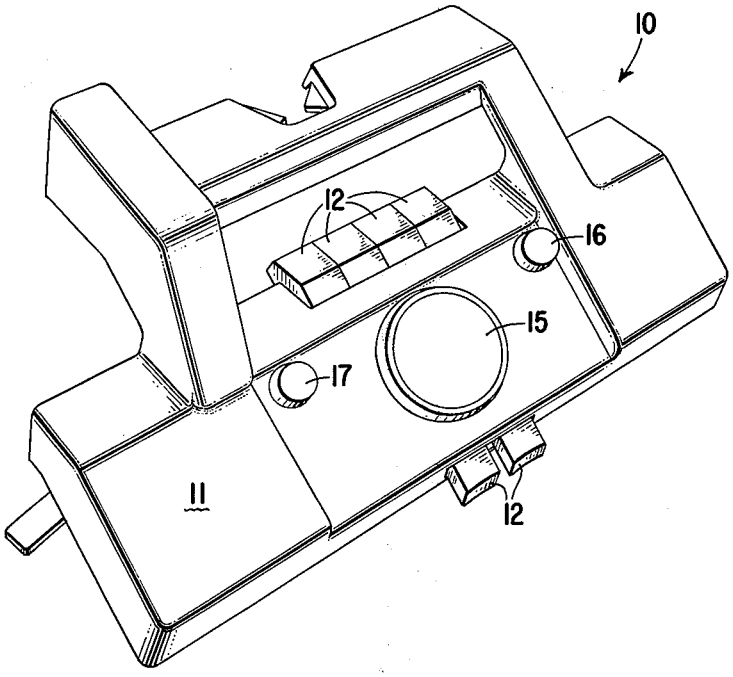
FIG. 1 is a perspective view of a carriage embodying the invention.
Figure 3:
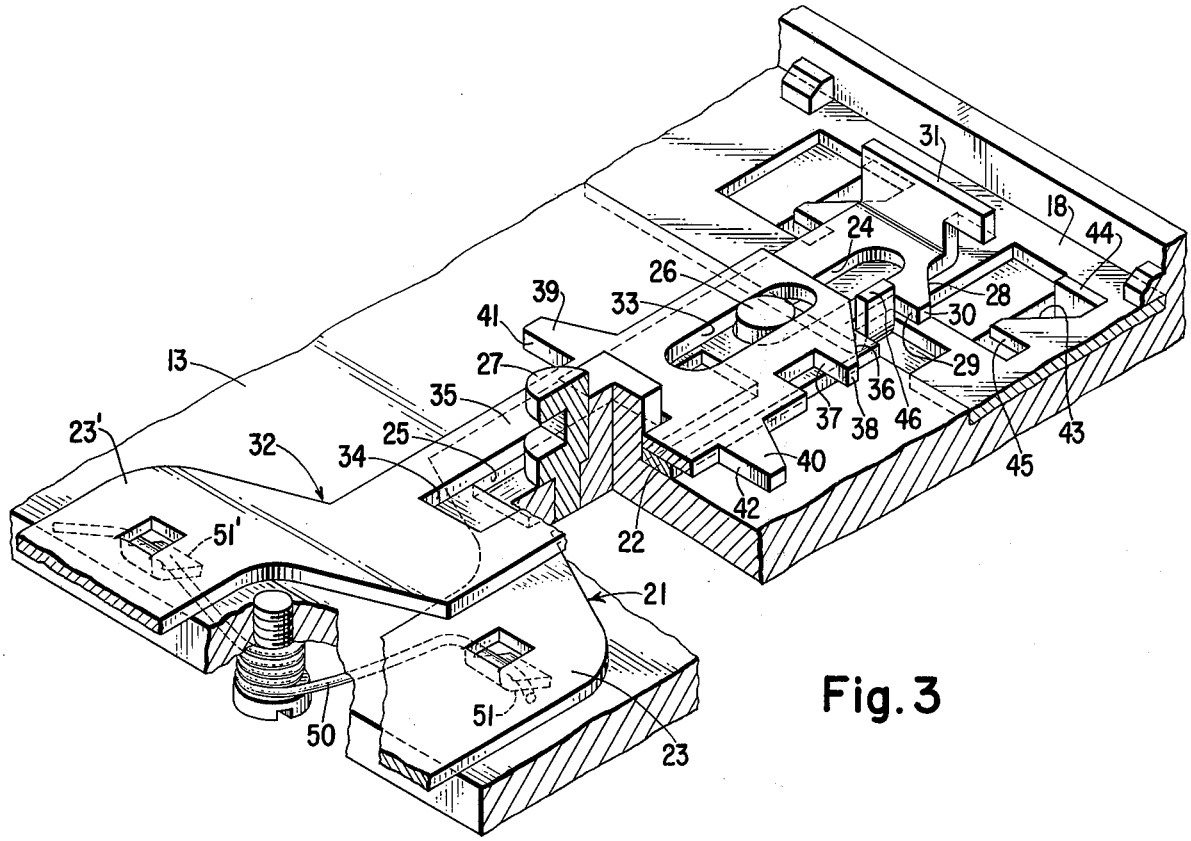
FIG. 3 is a perspective view, broken and partly in section, of the lever and locking plate construction of the carriage of FIGS. 1 and 2.

Referring to the drawings, there is shown a carriage 10 for a hand knitting machine. The upper face 11 of the carriage is provided with a plurality of punch keys 12 which are connected, through a lever arrangement to be hereinafter described, to selected cams located on the underside 13 of the carriage. By manipulation of the keys the cams may be arranged in a predetermined manner so as to present to the knitting needles a raceway through the cam system 14 for the production of the desired pattern. In addition to the punch keys, the upper face of the carriage may be provided with a stitch size dial 15 by which the size of the knitted stitch may be regulated through control of the downward movement of the needles. Three-position needle return buttons 16 and 17 are shown and function in a manner well known to persons having a familiarity with hand knitting machines. A locking plate 18 is mounted on the underside of the carriage and is slidable laterally thereof. This plate 18 is spring biased by compression spring 55, trapped between the locking plate and a pin 56 projecting from the underside 13 of the carriage, so as to urge same towards an extreme lateral position when all of the punch keys are in a nonactuated condition. In such condition the carriage, upon reciprocation, will function in a non-stitching mode. In order to produce patterned knitting it is necessary to depress one or more of the punch keys and to set the three position needle return buttons 16 and 17 to prescribed positions, thereby so positioning the cams as to provide a specific cam raceway for selected and non-selected needles through the cam system.

Figure 6:
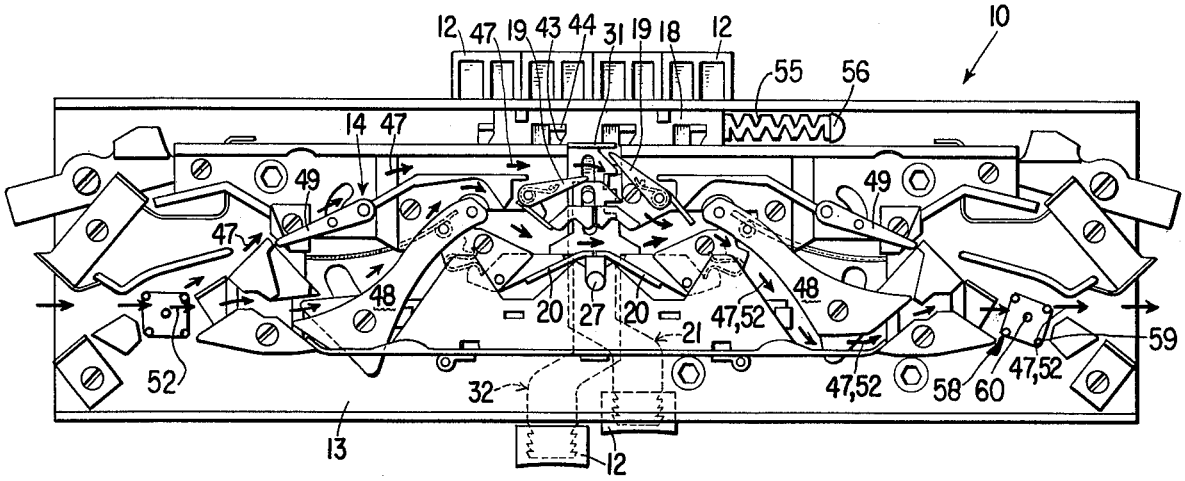
FIG. 6 is a schematic layout of a cam raceway which enables the production of Punch Lace.

As can be seen most clearly from FIG. 2, in order to provide the capability for production of Punch Lace and Fair Isle knitting, pairs of upper and lower Jacquard cams 19, 20 resepectively are pivotably mounted on the carriage biased towards their upper operative positions. As will be described hereinafter, with reference to FIGS. 6 and 7 of the drawings, only the upper Jacquard cams need be placed in their upper operative position to produce Punch Lace whereas both upper and lower Jacquard cams must be in their upper operative positions to produce Fair Isle knitting.

Figure 8:
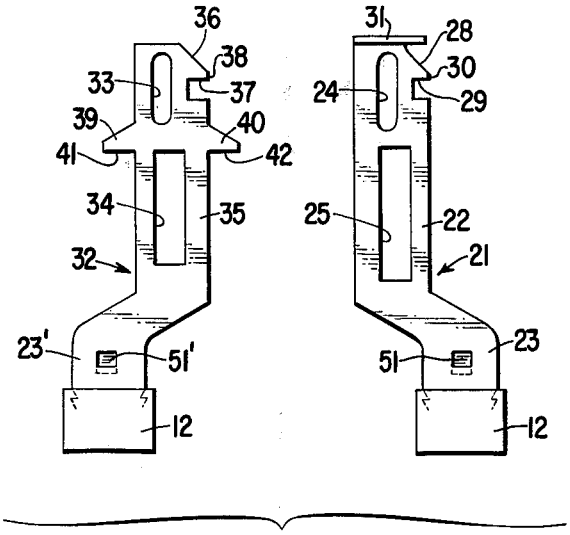
FIG. 8 is a plan view of the first and second levers according to the invention.

As viewed in FIG. 2, upper Jacquard cam control lever 21 is mounted on the underside of the carriage so as to be slidable in a plane below that in which locking plate 18 is adapted to slide and in a direction perpendicular to the direction of movement of the locking plate. Referring to FIG. 8, lever 21 is shown as being formed as a generally elongated member having a main body portion 22 and a shorter offset punch key-receiving shank 23. The main body portion is formed with a pair of longitudinally extending slots 24, 25 dimensioned to accept guide pins or studs 26, 27 which are formed on the carriage and project upwardly therefrom. In this manner the lever is capable of guided movement into engagement with the locking plate to be locked in position when, upon actuation, upper Jacquard cams 19 are moved to their upper operative position. The lever is provided on one side of its body portion, adjacent the end thereof which is remote from the offset shank 23, with a downwardly inclined ramp 28 and with a recess 29. The recess is located closely adjacent the terminus of ramp 28 for a purpose which will be subsequently described. Preferably, a land 30, which may be flat or slightly convex in configuration, connects the end of the ramp and the adjacent side wall of the recess. The free end of body 22 is formed with an upstanding retaining flange 31 which serves to urge upper Jacquard cams 19 into their lower position when the lever 21 is itself in a non-actuated position.

A lower Jacquard cam control lever 32 is mounted on the underside of the carriage and is positioned on studs 26, 27 overlying lever 21. Longitudinally extending slots 33, 34 are provided on the body portion 35 of lever 32, said slots being in longitudinal alignment with the underlying slots of lever 21. As previously described with reference to the upper Jacquard cam control lever 21, lever 32 is formed with a downwardly inclined ramp 36 and with a recess 37 whose adjacent sidewall is spaced from the terminus of ramp 36 by a land 38. This land is preferably given the same configuration as land 30. The body portion of lever 32 is also provided with a pair of wing projections 39, 40 offering lower cam-retaining shoulders 41, 42 by which the lower Jacquard cams may be urged into and maintained in their lower position. As with upper Jacquard cams 19, the lower Jacquard cams 20 are normally biased upwardly towards their upper operative position. The upper surface of the wing projections are desirably tapered to permit movement of the lever without interference with any of the adjacent elements of the carriage or cam-supporting structure. This lever, as with lever 21, is provided with a short offset shank portion 23' for reception of a punch key 12.

As stated previously, locking plate 18 is mounted on the underside of the carriage so as to be slidable laterally thereof. A plurality of ramps 43 are formed thereon at locations where they are respectively engageable by lug means 44 carried by each of the punch key-lever combinations. Thus, depression of any punch key will cause its associated lug to ride along the ramp of the locking plate with which it is engageable to thereby cause the locking plate to slide laterally. A recess 45 is provided on the locking plate at the end of each said ramp and is dimensioned to accept lug 44 of the respective punch key-lever combination. In known manner the punch key-lever is operatively connected with one or more cams such that when the punch key is actuated the cams operatively connected thereto are likewise moved between non-operative and operative positions. Since this aspect of the structure is known, for example from the carriage marketed by The Singer Company as part of their Model 2200 series of hand knitting machines, and is not critical to the present invention this specification will not be encumbered by a description of the details of such structure. Reference is also made to the disclosure of U.S. Pat. Nos. 3,103,110 and 3,120,114 issued Sept. 10, 1963 and Feb. 4, 1964 respectively for further examples of how punch key-lever combinations may be operatively connected to cams of a home knitting machine carriage. Locking plate 18 is also provided with an upstanding lug or ear 46 for disposition in either of recesses 29 or 37 of levers 21 or 32 depending upon which of the punch key-lever combinations is actuated.

Figure 4A:
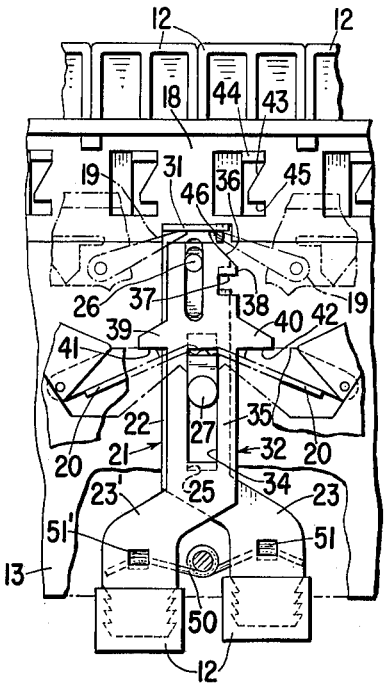
FIGS. 4*a*, *b* and *c* are plan stagewise views of first and second levers and of the locking plate during positioning of the upper Jacquard cams for production of Punch Lace.
Figure 4B:
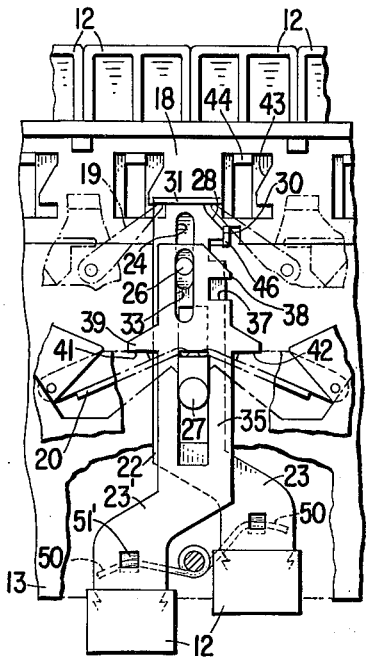
Figure 4C:
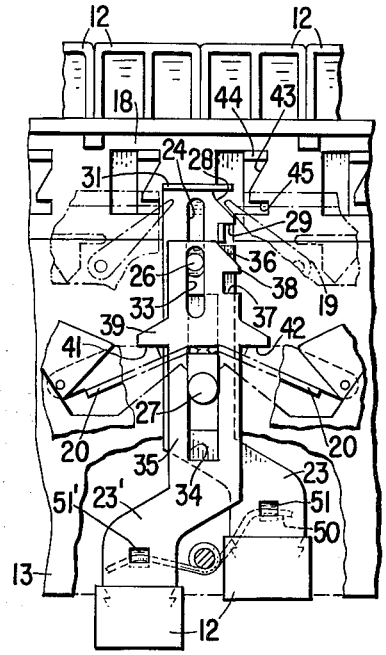
Figure 5A:
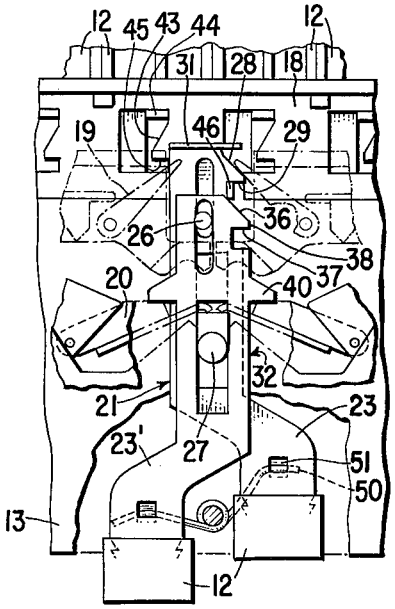
FIGS. 5*a*, *b* and *c* are plan views similar to that of FIGS. 4*a*, *b* and *c* showing stagewise lever and cam settings for production of Fair Isle knitting.
Figure 5B:
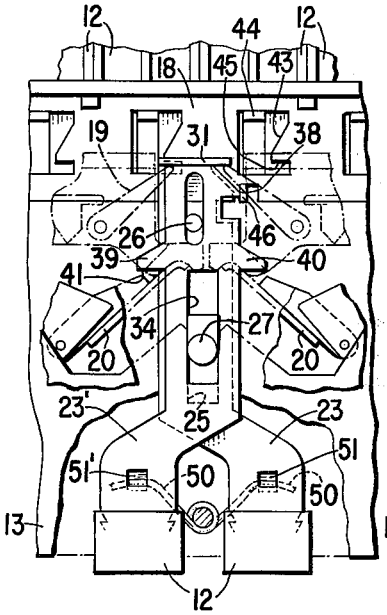
Figure 5C:
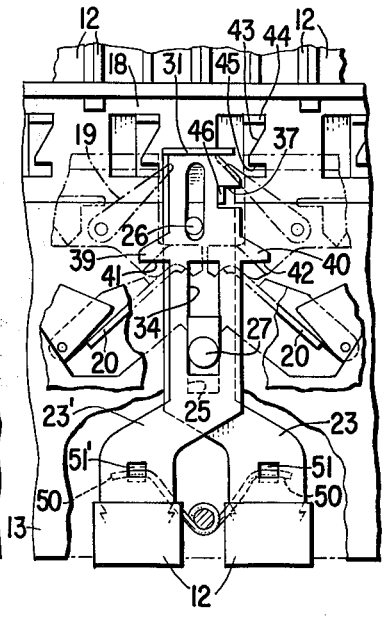

Referring now to FIGS. 4 and 5, the operation of cam control levers 21 and 32 will be described. When the operator desires to produce Punch Lace, upper Jacquard cam control lever 21 is depressed. In their initial non-actuated positions levers 21 and 32 are under the influence of spring 50 which acts upon turned up ears 51 and 51' on the respective levers. The lever begins to move upwardly as depicted in FIG. 4*a*, ramp 28 engaging with lug 46 to urge locking plate 18 to the right against the force of its biasing spring 55. The lever 21 continues upwards until lug 46 reaches the lower terminus of ramp 28. This lug then rides downwardly along land 30 as shown in FIG. 4*b* until it snaps into recess 29 under the influence of the locking plate biasing spring 55 as depicted by FIG. 4*c*. In this condition the upper Jacquard cams 19, which are spring biased upwardly but are normally restrained in their lower position by retaining flange 31 of lever 21, are permitted to be spring-urged upwardly into their upper operative position. Since lever 32 has not been actuated, the lower Jacquard cams 20 are retained in their lower position by shoulders 41, 42 of lever 32. Stitch cams 48 and three-position cams 49 having been set as shown, a cam raceway for selected needles shown by arrows 47 is thus provided and a cam raceway identified by arrows 52 is provided for non-selected needles as may be observed from FIG. 6. The needles may, in an appropriate configuration, be selected by hand; or by cam as disclosed in the U.S. Pat. No. 3,063,270 of Schurich, Nov. 13, 1962; or by electromechanical means as taught in the U.S. Pat. No. 2,173,488 of Tandler, Sept. 19, 1939; or by a device having a memory means as disclosed in the U.S. Pat. No. 3,358,473 of Suzake, Dec. 19, 1967. The more exotic designs may be fashioned automatically with a device as disclosed by the latter patent, whereas a simple design may be easily implemented by hand, or by a cam 58 rotatable on stud 60, wherein every other needle is elevated by the lobes 59, of the cam as the carriage is moved across the needle bed, alternate needles passing between the lobes. It will be noted that the needles which follow the high path through the cam system are directed over the left-hand three-position cam 49, over the first of upper spring loaded Jacquard cams 19 and thence below the second upper Jacquard cam which guides the needles downwardly to a point at the top of the right-hand stitch cam 48, and thence out of the carriage. These selected needles will accept a thread, such as a nylon yarn, before they are guided downwardly by the right-hand stitch cam 48. Concurrently, the non-selected needles are guided over the left-hand stitch cam 48, which serves as a raise cam for the non-selected needles, and across the top of the lower Jacquard cams. These non-selected needles are raised to a level by the left-hand stitch cam 48 such that they accept a heavier yarn, preferably colored, and the aforementioned thread pulled down to a pickup position for the non-selected needles by selected needles already acted on by the right-hand stitch cam 48, before then joining the selected needles at approximately the same point on the right-hand stitch cam 48 where they are then guided downwardly to set the stitch before leaving the carriage the transfer of a yarn from the hook of a high level needle to one at a low level is best shown in U.S. Pat. No. 3,748,873 on page 7, lines 35–65, where the yarn guides 52 and 53 are located at different levels to selectively transfer thread to needles following high or low level paths, designated as C' and B' in FIG. 5 of the drawings. In the instant case the selected needle having picked up a thread from a higher level is brought to a lower position by the right hand stitch cam whereby the hook of the non-selected needle can catch this thread before it is acted on by the right hand stitch cam 48 and brought to a position where its latch is closed.

In order to rearrange the cams so that the operator may then produce Fair Isle knitting it is merely necessary to depress cam control lever 32. As shown by FIG. 5*a*, actuation of the lever 32 results in lever movement substantially the same as described previously with respect to lever 21. Thus, as lever 32 moves upwardly, ramp 36 engages with lug 46 on the locking plate and forces the locking plate to the right against the bias of the locking plate spring 55. Lug 46 is forced out of recess 29 of lever 21 —thereby unlocking lever 21. The lug then moves downwardly along ramp 36 of cam control lever 32 and into recess 37 thereof to lock both of cam control levers 21 and 32 into their upper operative positions and thereby permitting both of the upper and lower Jacquard cams 19 and 20 to shift upwards under the influence of their springs to adopt an upper operative locked position. When so positioned, as may be seen from FIG. 7, the selected needles follow the high path through the cam system as described in connection with the cam alignment for Punch Lace. However, the non-selected needles will follow the lower path over the left-hand stitch cam, which serves as a raise cam, over the left-hand lower Jacquard cam 20 and under the right-hand lower Jacquard cam 20 to be directed to a lower point on the right-hand stitch cam 48 than where the selected needles join said stitch cam. The non-selected and selected needles are then directed out of the carriage. In this Fair Isle cam configuration the high path needles will accept a first yarn before passing through the upper Jacquard cams 19 whereas the lower path needles will accept a second yarn before passing through the lower Jacquard cams 20.

Figure 7:
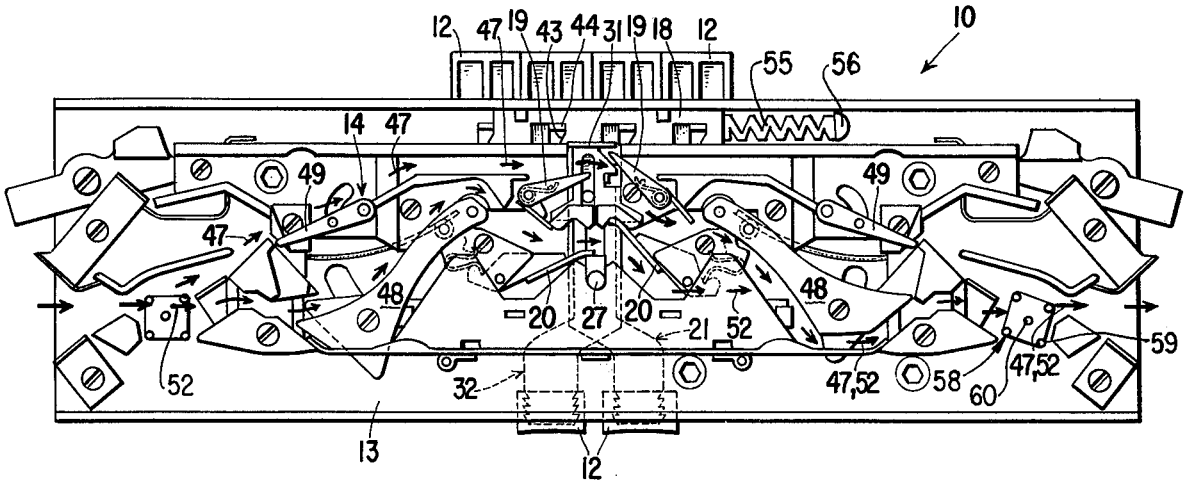
FIG. 7 is a view similar to that of FIG. 6 illustrating a cam raceway which enables the production of Fair Isle knitting.

In order to convert the cam system from the Fair Isle pattern configuration to an arrangement whereby a stocking knit can be produced, it is merely necessary to shift the three-position cams 49 to the appropriate position by a different setting of needle return buttons 16 and 17. There is no need to vary the position of either the upper or lower Jacquard cams 19 and 20. As is well known in the art the Jacquard cams are ineffective during a stocking knit since all needles are directed by the three position cams 49 into a path beneath the upper Jacquard cams 19. The lower Jacquard cams 20 are spring loaded as previously noted and are deflected away by needle passage thereby as is shown in FIG. 7. The upper Jacquard cams 19 are not utilized inasmuch as there in so requirement for high pass needles. Stocking knit refers to Jersey knit, i.e. a basic knit fabric. It will, of course, be appreciated that with levers 21 and 32 both in a non-actuated state it is simply necessary to actuate lever 32 in order to shift both sets of Jacquard cams to their upper positions to thereby produce Fair Isle knitting. In such event flange 31 of lever 21 is engaged by the upper terminus of lever 32 and lever 21 is thus actuated concomitantly with lever 32.

From the foregoing it will be seen that there has been provided an interconnected Jacquard cam control lever system whereby upper and lower Jacquard cams 19 and 20 can be selectively positioned to achieve either Punch Lace or Fair Isle knitting, and that without any modification of the position of either of the Jacquard cams the operator can convert to stocking knit by simply re-positioning the three-position cams 49.

Numerous alterations of the structure herein disclosed will suggest themselves to those skilled in the art. However, it is to be understood that the present disclosure relates to a preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In a carriage for a hand knitting machine having a plurality of cams that are sequentially arranged and adjustable between inoperative and operative positions to thereby define at least one raceway for the butts of knitting needles and in which a multiplicity of said cams are operatively connectable to individually actuable lever means to be shifted between said inoperative and operative positions, the improvement which comprises:

a first one of said lever means operatively connected to a first plurality of said cams for actuating only said first plurality of said cams to said operative position;

a second one of said lever means operatively connected to a second plurality of said cams for actuating said second plurality of said cams to said operative position; and, means associated with said first lever means and said second lever means which upon actuation of said second lever means operates on and actuates said first lever means whereby said first plurality of said cams and said second plurality of cams are both placed in operative positions.

2. A carriage according to claim 1, wherein said first plurality of said cams include a set of upwardly biased upper Jacquard cams and said second plurality of said cams include a set of upwardly biased lower Jacquard cams, each of said sets of Jacquard cams being normally maintained in their lowest setting by said respective associated first and second lever means, said first of said associated lever means being actuable to shift said upper Jacquard cams into their upper position, whereas said second lever means associated with said lower Jacquard cams is actuable to shift said lower Jacquard cams into their upper position and, where said upper Jacquard cams have not been shifted by its associated first lever means, to also shift the upper Jacquard cams to their upper position.

3. A carriage according to claim 1, wherein a locking plate is mounted on the underside thereof, said plate being slidable laterally of the carriage, means biasing said plate towards one extreme lateral position, each of said lever means being mounted on the underside of said carriage so as to be slidable in a direction generally perpendicular to the movement of said locking plate when actuated to shift said cams from an inoperative to an operative position, said lever means and locking plate having one each interacting lug means and ramp means for urging said locking plate against the force of said biasing means when said lever means is actuated to place said cams in said operative position, said lug means and one each recess means on said lever means and locking plate intermeshed when said cams are in said operative position to retain said lever means in said cam operative position, said first one of said lever means having an upstanding cam retaining flange at one end thereof, said second one of said lever means being positioned in overlying relation to said first lever means and adapted upon actuation to initially engage with said locking plate and with said cam retaining flange on said first lever means to release said first lever means from its retained position and upon continued movement to effectuate a simultaneous retaining of said first and second lever means by engagement of said lug means and recess means in said first and second lever means and said locking plate.

4. A carriage according to claim 3, wherein said pairs of upper and lower Jacquard cams are spring-biased towards an upper operative position, said cam-retaining flange on said first lever means being adapted to prevent said upper Jacquard cams from attaining the upper operative position until said first lever means is actuated, said second lever means being provided with a pair of cam-retaining shoulders adapted to prevent said lower Jacquard cams from attaining the upper operative position until said second lever means is actuated.

5. A carriage according to claim 2, wherein said upper and lower Jacquard cams are spring-biased towards their upper operative positions, said first lever means being provided with a cam-retaining flange adapted to prevent said upper Jacquard cams from attaining the upper operative position until said first lever means is actuated and said second lever means being provided with a pair of cam-retaining shoulders adapted to prevent said lower Jacquard cams from attaining an upper operative position until said second lever means is actuated.

* * * * *